US010280487B2

(12) United States Patent
Sagara et al.

(10) Patent No.: US 10,280,487 B2
(45) Date of Patent: May 7, 2019

(54) HIGH ALLOY FOR OIL WELL

(71) Applicant: NIPPON STEEL & SUMITOMO METAL CORPORATION, Tokyo (JP)

(72) Inventors: Masayuki Sagara, Nishinomiya (JP); Akiko Tomio, Nishinomiya (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 324 days.

(21) Appl. No.: 15/112,508

(22) PCT Filed: Feb. 5, 2015

(86) PCT No.: PCT/JP2015/000507
§ 371 (c)(1),
(2) Date: Jul. 19, 2016

(87) PCT Pub. No.: WO2015/118866
PCT Pub. Date: Aug. 13, 2015

(65) Prior Publication Data

US 2016/0333446 A1 Nov. 17, 2016

(30) Foreign Application Priority Data

Feb. 7, 2014 (JP) ..... 2014-022622

(51) Int. Cl.

| | |
|---|---|
| ***C22C 30/02*** | (2006.01) |
| ***C22C 38/44*** | (2006.01) |
| ***C22C 38/00*** | (2006.01) |
| ***C22C 38/08*** | (2006.01) |
| ***C22C 38/40*** | (2006.01) |
| ***C22C 38/42*** | (2006.01) |
| ***C21D 6/00*** | (2006.01) |
| ***C21D 8/10*** | (2006.01) |
| ***C21D 9/14*** | (2006.01) |

(52) U.S. Cl.
CPC ..... *C22C 30/02* (2013.01); *C21D 6/004* (2013.01); *C21D 8/105* (2013.01); *C21D 9/14* (2013.01); *C22C 38/001* (2013.01); *C22C 38/002* (2013.01); *C22C 38/005* (2013.01); *C22C 38/08* (2013.01); *C22C 38/40* (2013.01); *C22C 38/42* (2013.01); *C22C 38/44* (2013.01)

(58) Field of Classification Search
CPC ..... C22C 38/40
See application file for complete search history.

(56) References Cited

U.S. PATENT DOCUMENTS

| | | | | |
|---|---|---|---|---|
| 6,171,547 | B1 * | 1/2001 | Sagara | C22C 38/001 148/327 |
| 2008/0107559 | A1 | 5/2008 | Nishiyama et al. | |
| 2009/0081069 | A1 * | 3/2009 | Takeda | C22C 38/001 420/53 |

FOREIGN PATENT DOCUMENTS

| | | |
|---|---|---|
| CN | 101688263 | 3/2010 |
| JP | 63-083248 | 4/1988 |
| JP | 02-14419 | 4/1990 |
| JP | 11-189848 | 7/1999 |
| JP | 3235383 | 12/2001 |
| JP | 3650951 | 5/2005 |
| WO | 2009/014000 | 1/2009 |

OTHER PUBLICATIONS

English machine translation of JP 11189848 A of Sagara, Jul. 13, 1999 (Year: 1999).*

* cited by examiner

*Primary Examiner* — Jessee R Roe
*Assistant Examiner* — Jophy S. Koshy
(74) *Attorney, Agent, or Firm* — Clark & Brody

(57) ABSTRACT

The high alloy for oil well according to the present embodiment consists of, in mass %, C: 0.03% or less, Si: 1.0% or less, Mn: 0.05 to 1.5%, P: 0.03% or less, S: 0.03% or less, Ni: 26.0 to 40.0%, Cr: 22.0 to 30.0%, Mo: 0.01% or more to less than 5.0%, Cu: 0.1 to 3.0%, Al: 0.001 to 0.30%, N: more than 0.05% to 0.30% or less, O: 0.010% or less, and Ag: 0.005 to 1.0%, wherein the alloy satisfies the following Formula (1) and (2), wherein the high alloy for oil well has yield strength of 758 MPa or more:

$$5\times Cu+(1000\times Ag)^2\geq 40 \quad (1)$$

$$Cu+6\times Ag-500\times(Ca+Mg+REM)\leq 3.5 \quad (2)$$

where, each element symbol in each Formula is substituted by the content (in mass %) of each element.

4 Claims, No Drawings

HIGH ALLOY FOR OIL WELL

TECHNICAL FIELD

The present invention relates to a high alloy, and more particularly to a high alloy for oil well, which is to be used for oil wells and gas wells (hereinafter, oil wells and gas wells are collectively called as oil wells).

BACKGROUND ART

Recently, developments of deep oil wells have been promoted. Alloy materials to be used for such deep oil wells are required to have high strength. Moreover, a deep oil well has a high-temperature corrosive environment. Such a high-temperature corrosive environment has a temperature of around 200° C. and contains hydrogen sulfide. In a high-temperature corrosive environment, stress corrosion cracking (SCC) is likely to occur. Therefore, an alloy material for oil well, such as a casing and a tubing to be used for an oil well having a high-temperature corrosive environment, is required to have high strength and excellent SCC resistance.

However, as the strength of an alloy material for oil well increases, the hot workability thereof will deteriorate. Therefore, an alloy material for oil well is required to have excellent hot workability as well as high strength and excellent SCC resistance.

High alloy materials for use in a high-temperature corrosive environment have been disclosed in JP2-14419B (Patent Literature 1), JP63-83248A (Patent Literature 2), JP3650951B (Patent Literature 3), and JP3235383B (Patent Literature 4).

A high-alloy stainless steel disclosed in Patent Literature 1 consists of, in weight %, C: 0.005 to 0.3%, Si: 5% or less, Mn: 8% or less, P: 0.04% or less, Cr: 15 to 35%, Ni: 5 to 40%, N: 0.01 to 0.5%, S: 30 ppm or less, O: 50 ppm or less, one or more kinds of Al and Ti: 0.01 to 0.1%, one or more kinds of Ca and Ce: 0.001 to 0.03%, with the balance being Fe and impurities. In this high-alloy stainless steel, $3(Cr+1.5Si+Mo)-2.8(Ni+0.5Mn+0.5Cu)-84(C+N)-19.8$ is −10% or more, and $S+O-0.8Ca-0.3Ce$ is 40 ppm or less. Patent Literature 1 describes that since this high-alloy stainless steel has the above described chemical composition, it has excellent corrosion resistance and hot workability.

A high-Ni alloy for oil well pipe disclosed in Patent Literature 2 consists of, in weight %, C: 0.02% or less, Si: 1.0% or less, Mn: 1.0% or less, P: 0.01% or less, S: 0.01% or less, Cr: 18 to 28%, Mo: 3.0 to 4.5%, Ni: 18 to 35%, N: 0.08 to 0.20%, Ca: 0 to 0.01%, Mg: 0 to 0.01%, with the balance being Fe and impurities. This high-Ni alloy for oil well pipe has excellent SCC resistance. Further, Patent Literature 2 describes that the hot workability thereof is improved when Ca and/or Mg is contained.

A seamless steel pipe for oil well disclosed in Patent Literature 3 consists of, in weight %, Si: 0.05 to 1%, Mn: 0.1 to 1.5%, Cr: 20 to 35%, Ni: 25 to 50%, Cu: 0.5 to 8%, Mo: 0.01 to 1.5%, sol. Al: 0.01 to 0.3%, N: 0.15% or less, REM: 0 to 0.1%, Y: 0 to 0.2%, Mg: 0 to 0.1%, and Ca: 0 to 0.1%, with the balance being Fe and inevitable impurities. Further, in this seamless steel pipe for oil well, C, P, and S in the impurities are 0.05% or less, 0.03% or less, and 0.01% or less, respectively. This seamless steel pipe for oil well further satisfies $Cu \geq 1.2-0.4(Mo-1.4)^2$. Patent Literature 3 describes that this seamless steel pipe for oil well has excellent stress corrosion cracking resistance and excellent hot workability.

A high Cr-high Ni alloy disclosed in Patent Literature 4 consists of, in weight %, Si: 0.05 to 1.0%, Mn: 0.1 to 1.5%, Cr: 20.0 to 30.0%, Ni: 20.0 to 40.0%, sol-Al: 0.01 to 0.3%, Cu: 0.5 to 5.0%, REM: 0 to 0.10%, Y: 0 to 0.20%, Mg: 0 to 0.10%, and Ca: 0 to 0.10%, with the balance being Fe and inevitable impurities, wherein C, P, and S in the impurities are 0.05% or less, 0.03% or less, and 0.01% or less, respectively. This high Cr-high Ni alloy has excellent hydrogen sulfide corrosion resistance. Patent Literature 4 describes that the hot workability of this high Cr-high Ni alloy will be further improved when REM, Y, Mg, and Ca are contained.

CITATION LIST

Patent Literatures

Patent Literature 1: JP2-14419B
Patent Literature 2: JP63-83248A
Patent Literature 3: JP3650951B
Patent Literature 4: JP3235383B
Patent Literature 5: JP11-189848A

SUMMARY OF INVENTION

Technical Problem

However, even in alloys described in Patent Literatures 1 to 4, there may be cases in which SCC still occurs, and/or hot workability is insufficient.

It is an objective of the present invention to provide a high alloy for oil well, which has high strength, as well as excellent hot workability and excellent SCC resistance.

Solution to Problem

A high alloy for oil well according to the present embodiment has a chemical composition which consists of, in mass %, C: 0.03% or less, Si: 1.0% or less, Mn: 0.05 to 1.5%, P: 0.03% or less, S: 0.03% or less, Ni: 26.0 to 40.0%, Cr: 22.0 to 30.0%, Mo: 0.01% or more to less than 5.0%, Cu: 0.1 to 3.0%, Al: 0.001 to 0.30%, N: more than 0.05% to 0.30% or less, O: 0.010% or less, Ag: 0.005 to 1.0%, Ca: 0 to 0.01%, Mg: 0 to 0.01%, and rare earth metals: 0 to 0.2%, with the balance being Fe and impurities, and satisfies the following Formulae (1) and (2), wherein the high alloy for oil well has yield strength of 758 MPa or more:

$$5\times Cu-(1000\times Ag)^2 \geq 40 \quad (1)$$

$$Cu+6\times Ag-500\times(Ca+Mg+REM) \leq 3.5 \quad (2)$$

where, each element symbol in Formulae (1) and (2) is substituted by the content (in mass %) of each element, and REM is substituted by a total content (in mass %) of the rare earth metals.

Advantageous Effects of Invention

The high alloy for oil well according to the present embodiment has high strength, as well as excellent hot workability and excellent SCC resistance.

DESCRIPTION OF EMBODIMENTS

The present inventors have conducted investigation and given consideration on the SCC resistance and the hot workability of a high alloy. As a result, they have obtained the following findings.

A high alloy containing, in mass %, Cr: 22.0 to 30.0%, Ni: 26.0 to 40.0%, and Mo: 0.01% or more to less than 5.0% has high strength and high corrosion resistance in a high-temperature corrosive environment.

When Cu is further contained in the above described high alloy, the SCC resistance will be improved owing to Ni, Mo, and Cu. Ni, Mo, and Cu react with hydrogen sulfide to form sulfide at the surface of the high alloy. The sulfide will suppress hydrogen sulfide from intruding into the alloy. For that reason, a Cr oxide film is more likely to be formed at the surface of the high alloy. As a result, the SCC resistance of the high alloy will be improved.

However, when Cu content is too high, the hot workability of the high alloy will deteriorate. Thus, when an upper limit of Cu content is 3.0%, the hot workability is maintained.

When Ag is contained in the above described high alloy, the SCC resistance thereof will be further improved. Ag forms sulfide (AgS) at the surface of the high alloy, as with Ni, Mo, and Cu. Therefore, having Ag being contained will cause a Cr oxide film to be formed more stably. As a result, the SCC resistance of the high alloy will be improved.

The high alloy for oil well of the present embodiment, which has been completed based on the findings described above, has a chemical composition which consists of, in mass %, C: 0.03% or less, Si: 1.0% or less, Mn: 0.05 to 1.5%, P: 0.03% or less, S: 0.03% or less, Ni: 26.0 to 40.0%, Cr: 22.0 to 30.0%, Mo: 0.01% or more to less than 5.0%, Cu: 0.1 to 3.0%, Al: 0.001 to 0.30%, N: more than 0.05% to 0.30% or less, O: 0.010% or less, Ag: 0.005 to 1.0%, Ca: 0 to 0.01%, Mg: 0 to 0.01%, and rare earth metals: 0 to 0.2%, with the balance being Fe and impurities, and satisfies the following Formulae (1) and (2), wherein the high alloy for oil well has yield strength of 758 MPa or more:

$$5\times Cu+(1000\times Ag)^2\geq 40 \quad (1)$$

$$Cu+6\times Ag-500\times(Ca+Mg+REM)\leq 3.5 \quad (2)$$

where, each element symbol in Formulae (1) and (2) is substituted by the content (in mass %) of each element, and REM is substituted by a total content (in mass %) of the rare earth metals.

The above described high alloy for oil well may contain one or more kinds selected from the group consisting of Ca: 0.0005 to 0.01%, Mg: 0.0005 to 0.01%, and rare earth metals: 0.001 to 0.2%.

Hereinafter, the high alloy for oil well of the present embodiment will be described in detail. The symbol "%" with the content of each element means "mass %".

[Chemical Composition]

The chemical composition of the high alloy for oil well according to the present embodiment consists of the following elements.

C: 0.03% or Less

Carbon (C) is inevitably contained. C forms Cr carbide at grain boundaries, thereby increasing the stress corrosion cracking susceptibility of the alloy. That is, C deteriorates the SCC resistance of the alloy. Therefore, the C content should be 0.03% or less. The upper limit of the C content is preferably less than 0.03%, more preferably 0.028%, and further preferably 0.025%.

Si: 1.0% or Less

Silicon (Si) deoxidizes the alloy. However, when the Si content is too high, the hot workability of the alloy deteriorates. Therefore, the Si content should be 1.0% or less. The lower limit of the Si content is preferably 0.01%, and more preferably 0.05%. The upper limit of the Si content is preferably less than 1.0%, more preferably 0.9%, and further preferably 0.7%.

Mn: 0.05 to 1.5%

Manganese (Mn) deoxidizes the alloy. When the Mn content is too low, this effect cannot be achieved. On the other hand, when the Mn content is too high, the hot workability of the alloy will deteriorate. Therefore, the Mn content should be 0.05 to 1.5%. The lower limit of the Mn content is preferably more than 0.05%, more preferably 0.1%, and further preferably 0.2%. The upper limit of the Mn content is preferably less than 1.5%, more preferably 1.4%, and further preferably 1.2%.

P: 0.03% or Less

Phosphorous (P) is an impurity. In a hydrogen sulfide environment, P increases the stress corrosion cracking susceptibility of the alloy. Thus, the SCC resistance of the alloy deteriorates. Therefore, P content should be 0.03% or less. The P content is preferably less than 0.03%, and more preferably 0.027% or less. The P content is preferably as low as possible.

S: 0.03% or Less

Sulfur (S) is an impurity. S deteriorates the hot workability of the alloy. Therefore, the S content should be 0.03% or less. The S content is preferably less than 0.03%, more preferably 0.01% or less, and further preferably 0.005% or less. The S content is preferably as low as possible.

Ni: 26.0 to 40.0%

Nickel (Ni), together with Cr, improves the SCC resistance of the alloy. In a hydrogen sulfide environment, Ni forms Ni sulfide at the surface of the alloy. Ni sulfide suppresses hydrogen sulfide from intruding into the alloy. For that reason, a Cr oxide film is likely to be formed in an outer layer of the alloy, thereby improving the SCC resistance of the alloy. When the Ni content is too low, the above described effect cannot be achieved. On the other hand, when the Ni content is too high, the cost of the alloy increases. Therefore, the Ni content should be 26.0 to 40.0%. The lower limit of the Ni content is preferably more than 27.0%, and more preferably 28.0%. The upper limit of the Ni content is preferably less than 40.0%, and more preferably 37.0%.

Cr: 22.0 to 30.0%

Chromium (Cr), together with Ni, Mo, Cu, and Ag, improves the SCC resistance of the alloy. As a result of Ni, Mo, Cu, and Ag forming sulfide, Cr forms an oxide film at the surface of the alloy. The Cr oxide film improves the SCC resistance of the alloy. When the Cr content is too low, the above described effect cannot be achieved. On the other hand, when the Cr content is too high, the above described effect will be saturated, and further the hot workability of the alloy will deteriorate. Therefore, the Cr content should be 22.0 to 30.0%. The lower limit of the Cr content is preferably more than 22.0%, more preferably 23.0%, and further preferably 24.0%. The upper limit of the Cr content is preferably less than 30.0%, more preferably 29.0%, and further preferably 28.0%.

Mo: 0.01% or More to Less Than 5.0%

Molybdenum (Mo), together with Cr, improves the SCC resistance of the alloy. Specifically, Mo forms sulfide at the surface of the alloy, and suppresses hydrogen sulfide from intruding into the alloy. For that reason, it is likely that Cr oxide film is formed at the surface of the alloy, thereby improving the SCC resistance of the alloy. When the Mo content is too low, the above described effect cannot be achieved. On the other hand, when the Mo content is too high, the above described effect is saturated, and further the hot workability of the alloy deteriorates. Therefore, the Mo content should be 0.01% or more to less than 5.0%. The lower limit of the Mo content is preferably more than 0.01%, more preferably 0.05%, and further preferably 0.1%. The upper limit of the Mo content is preferably 4.5%, more preferably 4.2%, and further preferably 3.6%.

Cu: 0.1 to 3.0%

Copper (Cu), together with Cr, improves the SCC resistance of the alloy. Specifically, Cu is concentrated at the surface of the alloy in corrosion reaction under the presence of hydrogen sulfide. For that reason, sulfides are likely to be formed at the surface of the alloy. Cu forms stable sulfide at the surface of the alloy, thereby suppressing hydrogen sulfide from intruding into the alloy. As a result, it is likely that Cr oxide film is formed at the surface of the alloy, thereby improving the SCC resistance of the alloy. When the Cu content is too low, the above described effect cannot be achieved. On the other hand, when the Cu content is too high, the above described effect is saturated, and further the hot workability of the alloy deteriorates. Therefore, the Cu content should be 0.1 to 3.0%. The lower limit of the Cu content is preferably more than 0.1%, more preferably 0.2%, and further preferably 0.3%. The upper limit of the Cu content is preferably less than 3.0%, more preferably 2.5%, and further preferably 1.5%.

Al: 0.001 to 0.30%

Aluminum (Al) deoxidizes the alloy, and suppresses the formation of Si oxide and Mn oxide. When the Al content is too low, this effect cannot be achieved. On the other hand, when the Al content is too high, the hot workability of the alloy deteriorates. Therefore, the Al content should be 0.001 to 0.30%. The lower limit of the Al content is preferably more than 0.001%, more preferably 0.002%, and further preferably 0.005%. The upper limit of the Al content is preferably less than 0.30%, more preferably 0.25%, and further preferably 0.20%. The Al content herein means the content of acid-soluble Al (sol. Al).

N: More Than 0.05% to 0.30% or Less

Nitrogen (N) is solid-solved into the alloy, thereby increasing the strength of the alloy without deteriorating the corrosion resistance thereof. C also increases the strength of the alloy. However, C forms Cr carbide, thereby deteriorating the corrosion resistance and the SCC resistance of the alloy. Therefore, in the high alloy of the present embodiment, the strength is increased by N. Further, N increases the strength of an alloy material (for example, a material pipe) which has been subjected to solution treatment. Therefore, even if cold working with a low reduction rate is performed after solution treatment, it is possible to achieve an alloy material of high strength. In this case, there is no need of performing cold working with a high reduction rate to achieve high strength, and thus it is possible to suppress cracking caused by a decrease in ductility during cold working. When the N content is too low, this effect cannot be achieved. On the other hand, when the N content is too high, the hot workability of the alloy deteriorates. Therefore, the N content should be more than 0.05% to 0.30% or less. The lower limit of the N content is preferably 0.055%, more preferably 0.06%, and further preferably 0.065%. The upper limit of the N content is preferably less than 0.30%, more preferably 0.28%, and further preferably 0.26%.

O: 0.010% or Less

Oxygen (O) is an impurity. O deteriorates the hot workability of the alloy. Therefore, the O content should be 0.010% or less. The O content is preferably less than 0.010%, and more preferably 0.008% or less. The O content is preferably as low as possible.

Ag: 0.005 to 1.0%

Silver (Ag), together with Cr, improves the SCC resistance of the alloy. Ag is concentrated at the surface of the alloy in a corrosion reaction under the presence of hydrogen sulfide. For that reason, sulfides are likely to be formed on the surface of the alloy. Ag forms stable sulfide at the surface of the alloy, thereby suppressing hydrogen sulfide from intruding into the alloy. As a result, it is likely that Cr oxide film is formed at the surface of the alloy, thereby improving the SCC resistance of the alloy. When the Ag content is too low, this effect cannot be achieved. On the other hand, when the Ag content is too high, that effect is saturated, and further the hot workability of the alloy deteriorates. Therefore, the Ag content should be 0.005 to 1.0%. The lower limit of the Ag content is preferably more than 0.005%, more preferably 0.008%, and further preferably 0.01%. The upper limit of the Ag content is preferably less than 1.0%, more preferably 0.9%, and further preferably 0.8%. Ag is more likely to form sulfide compared with Cu.

The balance of the chemical composition of the high alloy for oil well according to the present embodiment is Fe and impurities. Here, the impurities mean those elements that are mixed from ores and scraps as the raw material, or from the production environment when the alloy is industrially produced.

The chemical composition of the high alloy for oil well according to the present embodiment may further contain one or more kinds selected from the group consisting of Ca, Mg, and rare earth metals (REM).

Ca: 0 to 0.01%

Mg: 0 to 0.01%

Rare Earth Metals (REM): 0 to 0.2%

Calcium (Ca), Magnesium (Mg), and rare earth metals (REM) are all optional elements, and may not be contained. If contained, these elements improve the hot workability of the alloy. However, when the contents of these elements are too high, coarse oxides are produced. Such coarse oxides deteriorate the hot workability of the alloy. Therefore, the Ca content should be 0 to 0.01%, the Mg content 0 to 0.01%, and the REM content 0 to 0.2%. The lower limit of the Ca content is preferably 0.0005%. The upper limit of the Ca content is preferably less than 0.01%, more preferably 0.008%, and further preferably 0.004%. The lower limit of the Mg content is preferably 0.0005%. The upper limit of the Mg content is preferably less than 0.01%, more preferably 0.008%, and further preferably 0.004%. The lower limit of the REM content is preferably 0.001%, and more preferably 0.003%. The upper limit of the REM content is preferably 0.15%, more preferably 0.12%, and further preferably 0.05%.

REM as used herein contains at least one or more kinds of Sc, Y, and lanthanides (La, atomic number 57, to Lu, atomic number 71). The REM content means a total content of these elements.

The chemical composition of the high alloy for oil well according to the present embodiment further satisfies Formula (1):

$$5\times Cu+(1000\times Ag)^2\geq 40 \quad (1)$$

where, each element symbol is substituted by the content (in mass %) of each element in Formula (1).

Now, we define as follows: $F1=5\times Cu+(1000\times Ag)^2$. F1 is an index relating to SCC resistance. Among elements (Cr, Ni, Mo, Cu, and Ag) which improve SCC resistance, Cu and Ag are concentrated at the surface of the ally in corrosion reaction particularly under the presence of hydrogen sulfide. For that reason, they are likely to form sulfides at the surface of the alloy. Cu and Ag form stable sulfide at the surface of the alloy. As a result, they stabilize the formation of Cr oxide film on the surface of the alloy. Ag remarkably improves SCC resistance compared with Cu. Therefore, F1 is defined as described above. When F1 value is 40 or more, the SCC resistance of the high alloy for oil well is improved. The lower limit of F1 is preferably 200, and more preferably 1000.

The chemical composition of the high alloy for oil well according to the present embodiment further satisfies Formula (2):

$$Cu+6\times Ag-500\times(Ca+Mg+REM)\leq 3.5 \quad (2)$$

where, in Formula (2), each element symbol is substituted by the content (in mass %) of each element, and REM is substituted by a total content (in mass %) of the rare earth metals.

Now, we define as follows: $F2 = Cu+6\times Ag-500\times(Ca+Mg+REM)$. F2 is an index relating to hot workability. Cu and Ag deteriorate the hot workability. On the other hand, Ca, Mg, and REM, which are optional elements, improve hot workability as described above. Therefore, when F2 value is 3.5 or less, the hot workability of the high alloy for oil well is improved. The upper limit of F2 value is preferably 3.0, and more preferably 2.4.

As described so far, when enough Cu and Ag to satisfy Formulae (1) and (2) are contained, excellent SCC resistance is exhibited, and further excellent hot workability is achieved.

[Production Method]

One example of production methods of the above described high alloy for oil well will be described. In the present example, a production method of a high alloy pipe for oil well will be described.

An alloy having the above described chemical composition is melted. Melting of the alloy is performed by using, for example, an electric furnace, an argon-oxygen mixed gas bottom-blowing decarburization furnace (AOD furnace), and a vacuum decarburizing furnace (VOD furnace).

The molten alloy thus melted may be used to produce an ingot by an ingot-making process, or to produce a billet by a continuous casting process. The ingot or billet is subjected to hot working to produce a material pipe. Examples of the hot working include hot extrusion by Ugine-Sejournet process, Mannesmann pipe making process, and the like. The material pipe produced by the hot working is subjected to solution heat treatment. The temperature of the solution heat treatment is preferably more than 1050° C. After the solution heat treatment, the material pipe is subjected to cold working to produce a high alloy pipe for oil well which has desired strength. The high alloy for oil well according to the present embodiment is subjected to cold working. The reduction rate of the cold working is preferably 20% or more in area reduction ratio. As a result, the strength will become 758 MPa (110 ksi) or more.

So far, a production method of a high alloy pipe has been described as an example of high alloys for oil well. However, the high alloy for oil well may be produced into other shapes other than the pipe shape. For example, the high alloy for oil well may be in the form of a steel plate, or may have any other shapes.

EXAMPLES

Alloys (molten alloys) having the chemical compositions shown in Table 1 were produced by a vacuum induction melting furnace.

TABLE 1

| Test | Chemical composition (in mass %, with the balance being Fe and impurities) | | | | | | | | | | |
|---|---|---|---|---|---|---|---|---|---|---|---|
| No. | C | Si | Mn | P | S | Ni | Cr | Mo | Cu | Al | N |
| 1 | 0.020 | 0.24 | 0.55 | 0.021 | 0.0002 | 30.22 | 26.25 | 2.89 | 0.82 | 0.032 | 0.0812 |
| 2 | 0.018 | 0.31 | 0.58 | 0.027 | 0.0004 | 29.15 | 24.39 | 3.02 | 0.71 | 0.034 | 0.0756 |
| 3 | 0.018 | 0.30 | 0.57 | 0.026 | 0.0004 | 27.39 | 26.81 | 3.15 | 0.66 | 0.034 | 0.0821 |
| 4 | 0.021 | 0.28 | 0.64 | 0.027 | 0.0003 | 32.95 | 25.27 | 2.91 | 0.77 | 0.036 | 0.1250 |
| 5 | 0.017 | 0.24 | 0.54 | 0.026 | 0.0002 | 29.33 | 24.95 | 1.20 | 0.84 | 0.031 | 0.1113 |
| 6 | 0.022 | 0.33 | 0.48 | 0.023 | 0.0003 | 31.57 | 25.05 | 0.03 | 0.21 | 0.033 | 0.0907 |
| 7 | 0.019 | 0.27 | 0.56 | 0.027 | 0.0002 | 27.03 | 25.71 | 3.24 | 2.50 | 0.034 | 0.1940 |
| 8 | 0.018 | 0.26 | 0.52 | 0.024 | 0.0003 | 31.40 | 25.82 | 3.12 | 2.18 | 0.021 | 0.1885 |
| 9 | 0.020 | 0.25 | 0.53 | 0.024 | 0.0002 | 30.02 | 24.88 | 2.97 | 2.31 | 0.035 | 0.0961 |
| 10 | 0.019 | 0.31 | 0.56 | 0.026 | 0.0003 | 30.55 | 25.94 | 3.05 | 1.43 | 0.029 | 0.0853 |
| 11 | 0.018 | 0.29 | 0.51 | 0.027 | 0.0003 | 29.64 | 26.12 | 2.50 | 0.97 | 0.032 | 0.0840 |
| 12 | 0.021 | 0.30 | 0.55 | 0.022 | 0.0003 | 28.39 | 24.18 | 2.81 | 2.37 | 0.033 | 0.1480 |
| 13 | 0.022 | 0.29 | 0.45 | 0.018 | 0.0002 | 27.84 | 25.31 | 0.45 | 3.32 | 0.037 | 0.0801 |
| 14 | 0.019 | 0.31 | 0.51 | 0.025 | 0.0004 | 30.27 | 25.61 | 2.94 | 0.60 | 0.030 | 0.0927 |
| 15 | 0.017 | 0.28 | 0.53 | 0.026 | 0.0003 | 29.07 | 25.79 | 2.79 | 1.08 | 0.029 | 0.0884 |
| 16 | 0.020 | 0.29 | 0.49 | 0.025 | 0.0002 | 30.41 | 26.55 | 2.10 | 0.63 | 0.031 | 0.0900 |
| 17 | 0.021 | 0.28 | 0.64 | 0.027 | 0.0003 | 32.95 | 25.27 | 2.91 | 0.77 | 0.036 | 0.1250 |
| 18 | 0.016 | 0.31 | 0.52 | 0.029 | 0.0004 | 25.12 | 24.96 | 2.01 | 0.32 | 0.035 | 0.1018 |
| 19 | 0.018 | 0.30 | 0.55 | 0.024 | 0.0003 | 28.11 | 25.52 | 2.88 | 0.30 | 0.034 | 0.0961 |
| 20 | 0.022 | 0.31 | 0.52 | 0.024 | 0.0004 | 27.89 | 25.96 | 2.43 | 2.45 | 0.033 | 0.0851 |

| Test | Chemical composition (in mass %, with the balance being Fe and impurities) | | | | | F1 | F2 | Performance evaluation test results | | |
|---|---|---|---|---|---|---|---|---|---|---|
| No. | O | Ag | Ca | Mg | REM | value | value | SCC | Reduction ratio (%) | YS (MPa) |
| 1 | 0.0041 | 0.040 | — | — | — | 1604 | 1.1 | NF | 73 | 781 |
| 2 | 0.0052 | 0.071 | 0.0029 | — | — | 5045 | −0.3 | NF | 86 | 791 |
| 3 | 0.0061 | 0.124 | 0.0019 | 0.0014 | — | 15379 | −0.2 | NF | 84 | 825 |
| 4 | 0.0064 | 0.048 | 0.0017 | 0.0011 | — | 2308 | −0.3 | NF | 89 | 793 |

TABLE 1-continued

| | | | | | | | | | | |
|---|---|---|---|---|---|---|---|---|---|---|
| 5 | 0.0047 | 0.436 | — | — | 0.003 | 190100 | 2.0 | NF | 72 | 812 |
| 6 | 0.0056 | 0.705 | 0.0025 | 0.0004 | — | 497026 | 3.0 | NF | 65 | 843 |
| 7 | 0.0051 | 0.043 | — | 0.0016 | — | 1862 | 2.0 | NF | 71 | 806 |
| 8 | 0.0048 | 0.006 | 0.0015 | — | — | 47 | 1.5 | NF | 74 | 821 |
| 9 | 0.0053 | 0.010 | — | — | — | 112 | 2.4 | NF | 61 | 781 |
| 10 | 0.0047 | 0.051 | — | — | 0.0028 | 2608 | 0.3 | NF | 79 | 768 |
| 11 | 0.0040 | 0.001 | 0.0031 | — | — | 6 | −0.6 | F | 82 | 815 |
| 12 | 0.0061 | 0.003 | — | 0.0011 | — | 21 | 1.8 | F | 69 | 793 |
| 13 | 0.0057 | 0.242 | 0.0024 | — | — | 58581 | 3.6 | NF | 40 | 841 |
| 14 | 0.0048 | 1.120 | 0.0027 | 0.0010 | — | 1254403 | 5.5 | NF | 31 | 833 |
| 15 | 0.0045 | 0.002 | — | — | — | 9 | 1.1 | F | 67 | 784 |
| 16 | 0.0052 | 0.001 | 0.0013 | — | 0.027 | 4 | −13.5 | F | 91 | 767 |
| 17 | 0.0064 | 0.048 | 0.0017 | 0.0011 | — | 2308 | −0.3 | NF | 89 | 291 |
| 18 | 0.0045 | 0.007 | — | — | 0.026 | 51 | −12.6 | F | 89 | 798 |
| 19 | 0.0051 | 0.005 | — | 0.0016 | — | 27 | −0.5 | F | 83 | 830 |
| 20 | 0.0055 | 0.350 | 0.0019 | — | — | 122512 | 3.6 | NF | 38 | 808 |

From each molten alloy, an ingot of 50 kg was produced. The ingot was heated to 1250° C. The heated ingot was subjected to hot forging at 1200° C. to produce a steel plate having a thickness of 25 mm.

[Hot Workability Evaluation Test]

From the above described steel plate, a round bar specimen, which conformed to JIS G0567 (2012), was collected. The parallel portion of the round bar specimen had a diameter of 10 mm and a length of 100 mm. The round bar specimen was soaked at 900° C. for 10 minutes. Thereafter, the heated round bar specimen was subjected to a high-temperature tensile test. The strain rate in the tensile test was 0.3%/minute. From the test result, a reduction ratio (%) of a specimen of each Test No. was determined.

[SCC Resistance Evaluation Test]

The steel plate of each Test No. was subjected to solution heat treatment at 1090° C. The steel plate after the solution heat treatment was water-cooled. The steel plate after the solution heat treatment was subjected to cold rolling at a rolling reduction of 35%. A specimen having a thickness of 2 mm, a width of 10 mm, and a length of 75 mm was collected from the steel plate after the cold rolling. The cold rolling was not performed in Test No. 17.

A stress corrosion cracking test was carried out by using each of the collected specimens. Specifically, each specimen was subjected to a 4-point bending test in which 100% of actual YS (yield stress) was applied to the specimen. A similar metal foil was attached by spot welding to a maximum stress part of the specimen.

An autoclave of 200° C. in which 1.0 MPa of $H_2S$ and 1.5 MPa of $CO_2$ were compressed and confined was prepared. In the autoclave, the above described 4-point bending specimen applied with the actual YS was immersed in 25 mass % aqueous solution of NaCl for one month. After having been immersed for one month, each specimen was investigated whether or not SCC had occurred therein.

Specifically, a longitudinal section of each specimen was observed by an optical microscope with a visual magnification of 100 times. Then, the presence/absence of SCC was determined by visual inspection.

[Yield Strength Measurement Test]

Each steel plate other than that of Test No. 17 was subjected to cold rolling. A round bar specimen whose parallel portion has a diameter of 6 mm was collected from each steel plate after cold rolling. Using each collected specimen, a tensile test conforming to JIS Z2241 (2011) was conducted to measure yield strength YS (0.2% proof stress).

[Test results]

Table 1 shows test results. The symbol "NF" in the "SCC" column in Table 1 means that SCC was not observed. The symbol "F" means that SCC was observed.

Referring to Table 1, the chemical compositions of high alloys of Test Nos. 1 to 10 were appropriate, and satisfied Formulae (1) and (2). For that reason, even though the yield strength was 758 MPa or more, no SCC was observed, and thus excellent SCC resistance was achieved. Further, every one of reduction ratios was 60% or more, and thus excellent hot workability was achieved.

Further, the Cu content of Test No. 1 was lower than the Cu content of Test No. 9. For that reason, the reduction ratio of Test No. 1 was higher than that of Test No. 9.

On the other hand, the Ag contents of Test Nos. 11, 12, 15, and 16 were too low. Further, they did not satisfy Formula (1). For that reason, SCC was observed, and thus SCC resistance was low.

The Ag content of Test No. 14 was too high. Further, it did not satisfy Formula (2). For that reason, the reduction ratio was less than 60%, and thus hot workability was low.

The Cu content of Test No. 13 was too high. Further, it did not satisfy Formula (2). For that reason, the reduction ratio was less than 60%, and thus hot workability was low.

The content of each element of Test No. 17 was appropriate, and satisfied Formulae (1) and (2). However, cold working was not performed. For that reason, the yield strength YS became less than 758 MPa.

The Ni content of Test No. 18 was too low. For that reason, SCC was observed, and thus SCC resistance was low.

The content of each element of Test No. 19 was appropriate. However, the chemical composition of Test No. 19 did not satisfy Formula (1). For that reason, SCC was observed, and thus SCC resistance was low.

The content of each element of Test No. 20 was appropriate. However, the chemical composition of Test No. 20 did not satisfy Formula (2). For that reason, the reduction ratio was less than 60%, and thus hot workability was low.

So far, embodiments of the present invention have been described. However, the above described embodiments are merely exemplification for carrying out the present invention. Therefore, the present invention will not be limited to the above described embodiments, and may be carried out by appropriately modifying the above described embodiments within a range not departing from its spirit.

The invention claimed is:

1. A high alloy for oil well having a chemical composition which consists of, in mass %, C: 0.03% or less, Si: 1.0% or less, Mn: 0.05 to 1.5%,
P: 0.03% or less,
S: 0.03% or less,
Ni: 26.0 to 40.0%,
Cr: 22.0 to 30.0%,
Mo: 0.01% or more to less than 5.0%,
Cu: 0.1 to 2.5%,
Al: 0.001 to 0.30%,
N: more than 0.05% to 0.30% or less,
O: 0.010% or less,
Ag: 0.005 to 1.0%,
Ca: 0 to 0.01%,
Mg: 0 to 0.01%, and
rare earth metals: 0 to 0.2%, with the balance being Fe and impurities, and satisfies the following Formulae (1) and (2), wherein
the high alloy for oil well has yield strength of 758 MPa or more:

$$5\times Cu-(1000\times Ag)^2\geq 40 \quad (1)$$

$$Cu+6\times Ag-500\times(Ca+Mg+REM)\leq 3.5 \quad (2)$$

where, each element symbol in Formulae (1) and (2) is substituted by the content in mass % of each element, and REM is substituted by a total content in mass % of the rare earth metals.

2. The high alloy for oil well according to claim 1, wherein a content of Ca is: 0.0005 to 0.01 mass %.

3. The high alloy for oil well according to claim 1, wherein a content of Mg is: 0.0005 to 0.01 mass %.

4. The high alloy for oil well according to claim 1, wherein a content of rare earth metals is: 0.001 to 0.2 mass %.

* * * * *